United States Patent [19]

Jenkins

[11] 4,164,881

[45] Aug. 21, 1979

[54] DIE CHASE APPARATUS

[76] Inventor: Henry H. Jenkins, 864 W. Hacienda Dr., Corona, Calif. 91720

[21] Appl. No.: 903,578

[22] Filed: May 8, 1978

[51] Int. Cl.[2] ..... B26F 1/38

[52] U.S. Cl. ..... 83/128; 83/509; 83/570; 83/597; 83/658

[58] Field of Search ..... 83/128, 509, 570, 658, 83/659, 679, 566, 597

[56] References Cited

U.S. PATENT DOCUMENTS

| | | | |
|---|---|---|---|
| 3,227,024 | 1/1966 | Krebs | 83/658 X |
| 3,311,278 | 3/1967 | Brandon | 83/570 X |

FOREIGN PATENT DOCUMENTS

| | | | |
|---|---|---|---|
| 1276818 | 6/1972 | United Kingdom | 83/509 |

*Primary Examiner*—Frank T. Yost

*Attorney, Agent, or Firm*—Woodling, Krost, Granger & Rust

[57] ABSTRACT

The present application discloses a die cutter assembly which includes in combination a plurality of flat wood layers which support a steel rule die for cutting paper such as cardboard and like material. Metal hinge members are secured to opposed sides of the flat wood layers and each hinge member has a portion which overhangs the wood layers. A pivot member extends from each overhanging portion. A cover is provided which is capable of moving between a closed and an open position and this cover member comprises a flat surface which is adapted to engage the steel rule die for cutting paper interposed between the steel rule die and the flat surface of the cover member. The cover member has four downturned edges to fit around the top edge of the wood layers in the closed position of the cover member. Two of the opposed downturned edges of the cover member have elongated slots which respectively receive the pivot members from the overhanging portions of the two metal hinges to permit the pivoting movement of the cover member between open and closed positions. The elongated slots are vertically oriented in the closed position of the cover member to permit unobstructed vertical movement of the cover member relative to the flat wood layers so that efficient cutting of cardboard between the flat surface of the cover member and the steel rule die can be accomplished.

6 Claims, 8 Drawing Figures

DIE CHASE APPARATUS

The present invention which is disclosed herein describes a die chase apparatus which, while capable of being used for many other purposes, is uniquely adapted to the process of cutting out predetermined configurations from large sheets of paper, plastic and the like. The present invention has particular utility in the skin packaging and blister packaging art wherein large paper sheets are utilized to package a plurality of packages during a skin or blister packaging operation and it is then necessary to sever each of the packages from each other in order that they may be separately handled and separately distributed to their ultimate point of consumption.

The die chase apparatus of the present invention includes primarily a bottom or base part, a cover which can be moved between open and closed positions and a die which is made up of a plurality of layers of plywood sheets which serve to support a steel rule die. The cover is moved to the open position in order to load a sheet into the apparatus and the cover is closed preparatory to performing the cutting function. With the cover member in closed position the cutting force is obtained by passing the closed assembly between two rollers which serve to urge the cover member vertically downwardly against the cutting edge of the steel rule die and by this means the cutting function is accomplished.

The present invention involves itself with several novel aspects, one of which is the hinged connection between the cover member and the die. In the present invention the two hinges provide a unique means of accommodating the pivot for the cover member and elongated slots in the cover member, or on each side of the cover member, permit free vertical movement of the cover member during the cutting operation. The hinge members of the present invention also provide a convenient means of locating the cover member so that there is little or no longitudinal shifting of the cover member relative to the die during the cutting operation. The hinge members of the present invention also provide a firm abutment for engagement with the cover member in the open position of the cover member so that undue wear is not received by the plurality of plywood sheets. The metal base of the die chase of the present invention is made longer than the length of the cover member and the die so that the drive rollers which exert the cutting force on the assembly will move the die chase apparatus completely out of the area of the drive rollers so that the cover member can be easily opened without engaging the rollers.

Other objects and a fuller understanding of this invention may be had by referring to the following description and claims, taken in conjunction with the accompanying drawings, in which:

Figure 1:
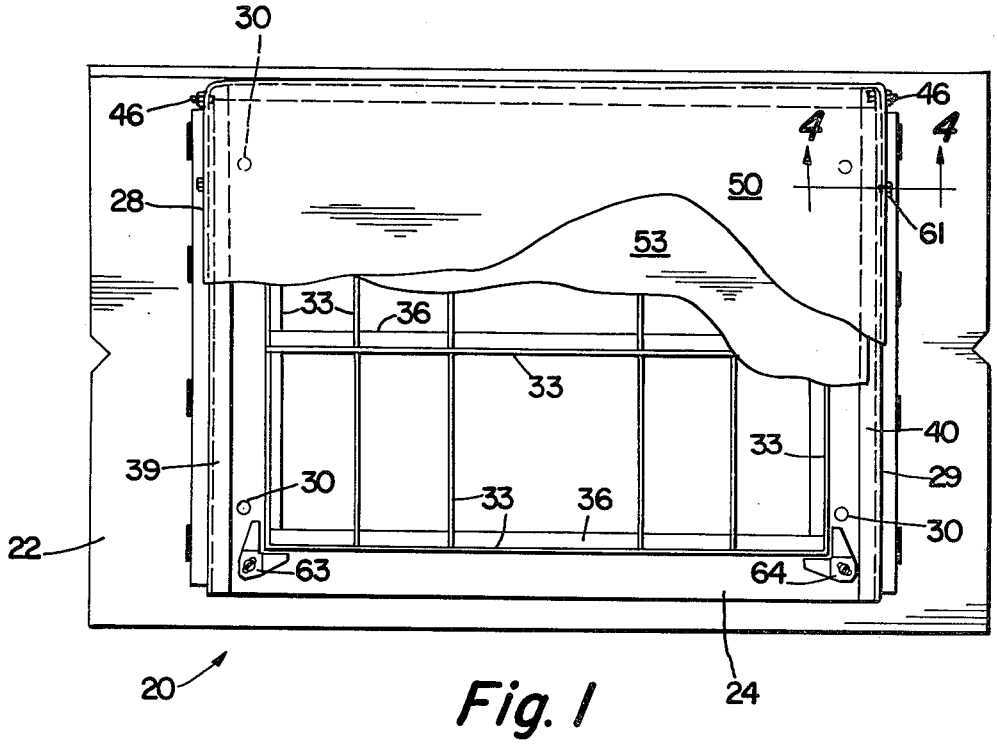
FIG. 1 is a plan view, partially in section, of the die chase apparatus of the present invention.

The die chase apparatus illustrated in the drawings has been indicated generally by the reference numeral 20 and includes in combination a generally rectangularly shaped metal base plate 22. First, second and third generally rectangularly shaped plywood sheets (a greater or less number may be used) flatly engage each other and the bottom sheet flatly engages the metal base plate 22. These plywood sheets have been identified by the reference numerals 24, 26 and 27 respectively. The sandwiched plywood sheets 24, 26 and 27 are secured in firm position on the metal base plate by means of first and second die locators 28 and 29, respectively. The die locators 28 and 29 are secured to the metal base plate by any suitable means and in this embodiment have been welded thereto. The die locators 28 and 29 are simply angle iron members having one leg thereof flatly engaging the metal base plate 22 with the other leg portion engaging ends of the bottom plywood sheet 27 thus holding the assembly in the aforedescribed position. It will be noted from FIG. 1 that the sandwiched plywood sheets are held in a position which is at a slight angle to the edges of the metal base plate 22 for a reason which will be described hereinafter. It might be said for the purpose of discussion that the sandwiched plywood sheets are slightly skewed with respect to the metal base plate. The sheets 24, 26 and 27 are secured to each other by members 30.

Figure 3:
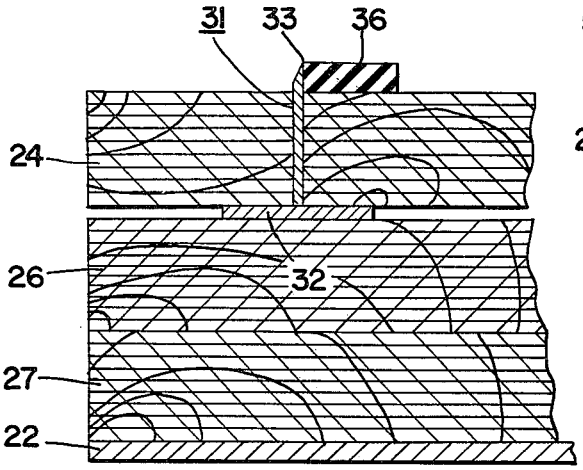
FIG. 3 is an enlarged fragmentary sectional view through the plywood sheets illustrating the method of supporting a steel rule die.

A steel rule 31 is held in position by means of the sandwiched plywood sheets as shown in FIG. 3. It will be noted that the steel rule has a base portion 32 which is secured between the bottom surface of sheet 24 and the top surface of sheet 26. A vertical portion of the steel rule extends through an opening in the first plywood sheet 24 and terminates in a cutting edge 33. It will be understood by those skilled in the art that the cutting edge of the steel rule is arranged in a predetermined configuration so as to cut a predetermined configuration from a sheet that is to be cut by the presently disclosed die chase cutter. The sandwiched plywood sheets may be referred to as a support member. A plurality of ejection members 36 constructed of a resilient material such as rubber are located on the top surface of plywood sheet 24 and closely adjacent the cutting edges 33 and are for the purpose of assisting in ejecting the sheet from the cutting edges 33 after a cutting function has been accomplished. This is accomplished by the ejection members 36 being compressed during the cutting operation and then by means of their resiliency ejecting the sheet from the cutting edge once the cover member has been moved to open position.

Figure 4:
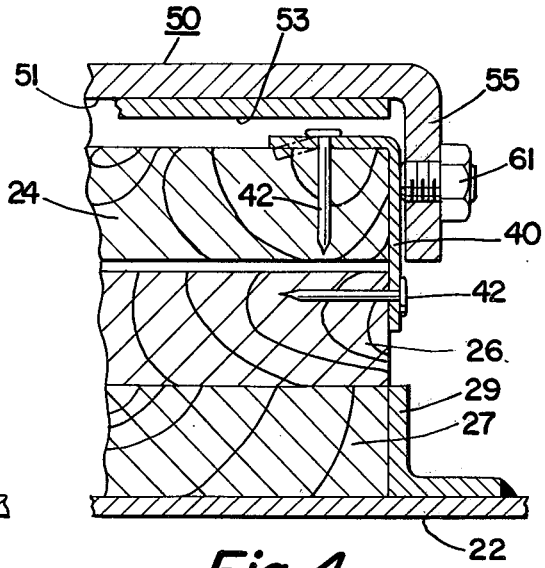
FIG. 4 is a view taken generally along the line 4—4 of FIG. 1.
Figure 5:
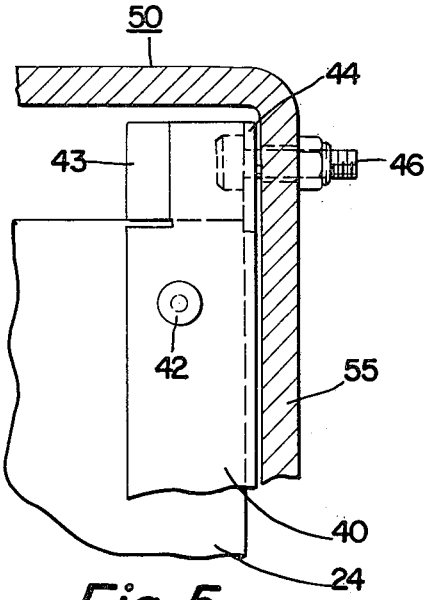
FIG. 5 is an enlarged fragmentary view looking in the vertical direction of FIG. 1 and illustrating a hinged connection between the cover member and the plurality of plywood sheets. This view is taken generally along the line 5—5 of FIG. 6.

First and second metal hinge members 39 and 40 are secured to opposed ends of the sandwich of plywood sheets. In this particular instance FIG. 4 shows a means of securing the hinge members and this figure also illustrates that each of the hinges comprises an angle shaped member which has a first portion flatly engaging the top surface of plywood sheet 24 with a second portion flatly engaging the side portions of sheets 24 and 26. Nails 42 secure the hinge members to the plywood sheets 24 and 26. Each of the hinge members is, also, provided with a bent portion 43 which engages an edge of plywood sheet 24 so as to properly longitudinally locate and orient the hinge member in position to be installed on the plywood sheet 24. Each of the hinge members 39 and 40 is also provided with an overhang portion 44 and the overhang portion overlies the side of the plywood sheet 24 in the manner illustrated in the drawings. A pivot member 46 extends laterally from each overhang portion 44 of each hinge member and each overhang portion is also provided with what has been referred to as an abutment 47.

A cover or chase member 50 is provided which has or is formed with downturned edges identified by the reference numerals 54, 55, 56 and 57 and the cover member also comprises a flat surface 51 to which is secured a replaceable striker plate 53. It will be understood by those skilled in the art that the function performed by the striker plate 53 can as easily be accomplished by the flat surface 51; however, for the sake of economy, the striker plate can be replaced when it has been sufficiently marked or worn by engagement with steel rule 31 so as to destroy its effectiveness.

Figure 2:
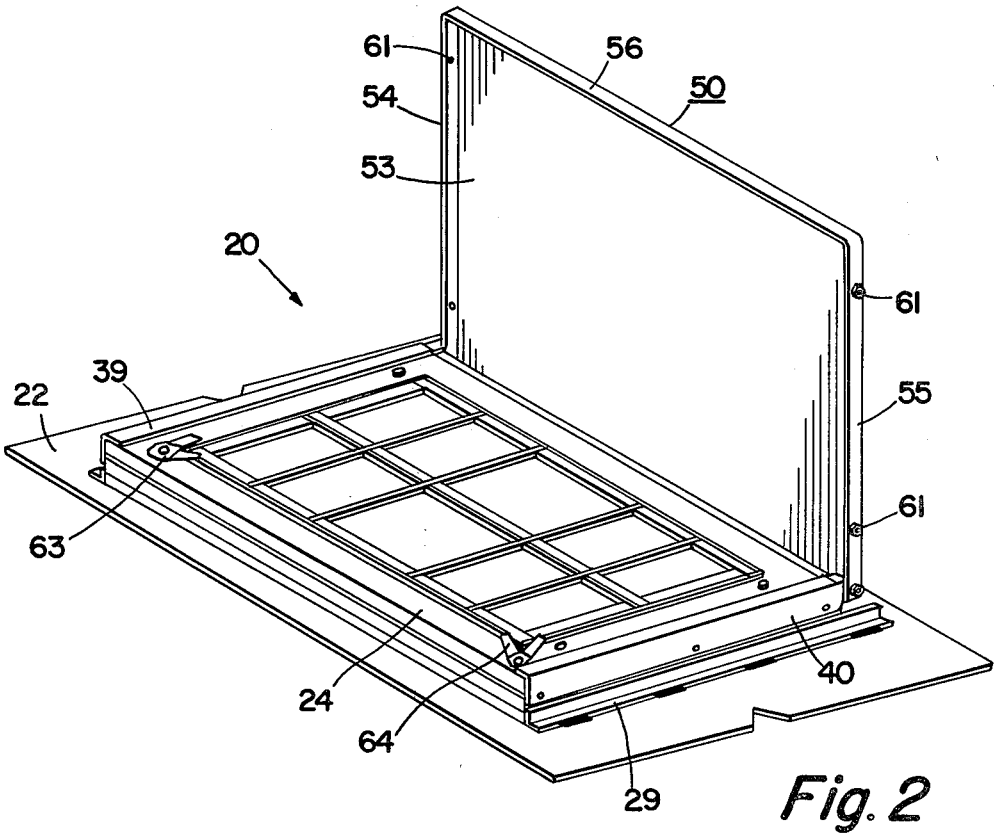
FIG. 2 is an isometric view of the die cutter apparatus shown in FIG. 1 with the cover member of the apparatus shown in open position.
Figure 8:
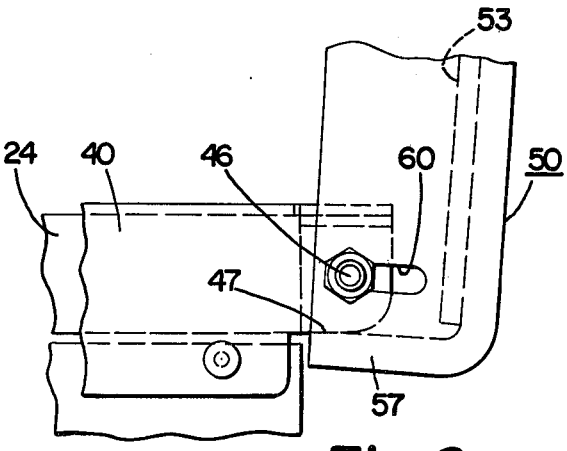
FIG. 8 is an elevational view of the hinged connection showing the cover member in open position.

The cover member is pivotally connected by the hinge members so that it can be moved between an open position, which is shown in FIGS. 2 and 8 and a closed position. This pivotal connection is provided by means of first and second elongated slots 60 in opposed downturned edges 54, 55 of the cover member and pivot members 46 which extend from the overhang portions 44 through the elongated slots.

Side set screws 61 are provided in the downturned edges 54, 55 in which the elongated slots 60 are provided and these side set screws 61 can be adjusted so that in closed position of the cover member there is a snug engagement between the cover member and the hinge members 39 and 40 (See FIG. 4) so as to prevent any lateral shifting between the cover member and the cutting edge on the steel rule die when accomplishing the cutting function.

Figure 6:
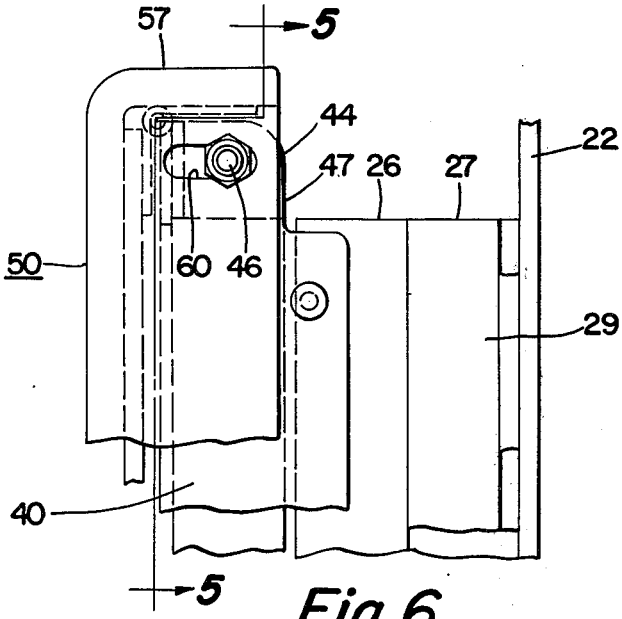
FIG. 6 is an elevational view showing a hinged connection between the cover member and the plurality of plywood sheets of the die.

FIG. 6 illustrates the function of the pivotal connection between the cover member 50 and hinge members 39, 40 by way of the pivot members 46 and the elongated slots 60. It will be noted that in the closed position of the cover member, as illustrated in FIG. 6, the elongated slots are oriented in a vertical direction when considering the normal position of the die chase apparatus and as the assembly passes through the force exerting rollers (not shown), the cover member is adapted to move freely in a vertical position relative to the cutting edge on the steel rule die and therefore conveniently accomplishes the cutting function without force being exerted upon the hinged connection. In the open position of the cover as shown in FIG. 8, it will be seen that downturned edge 57 engages the abutment 47 on the hinge member and thereby prevents engagement of the metal cover member with any of the plywood sheets thus preventing damage thereto. The reason for the positioning of the die locators 28 and 29 at a slight angle as previously described, is to also orient the cutting edges 33 as illustrated in FIG. 1 at a slight angle. This means when the die chase assembly is passed between the two force exerting rollers which are in the nature or configuration of the squeeze rollers on a wringer-type washing machine, that there is provided what might be referred to as a scissor-type of action in that the total force exerted by the rollers is exerted on a very short segment of each cutting edge.

The extra length of the metal base plate 22 at either end of the plywood sheets and/or the cover member 50, is for the purpose of engaging the force exerting rollers so that the die chase apparatus will be driven far enough outside the limits of the force exerting rollers that the cover member may be moved to open position without engaging the force exerting rollers.

Figure 7:
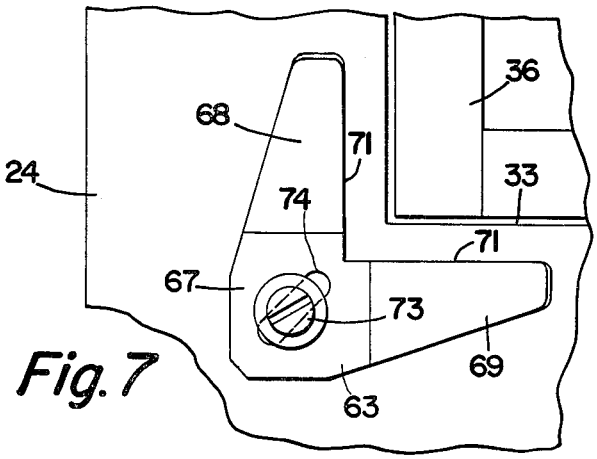
FIG. 7 is a plan view showing one of the locators used for positioning a paper sheet and seen in FIGS. 1 and 2.

FIG. 7 illustrates in detail the first and second locators 63 and 64, which are shown in FIGS. 1 and 2 of the drawings. Each of these locators includes a flat securing base 67 and integrally secured thereto and extending therefrom are first and second fingers 68 and 69, respectively. It will be seen that each finger extends at an acute angle to the plane of the securing base 67 and each of the fingers has an engaging edge 71 which edges are located at substantially right angles to each other. With this configuration and the use of the two locators 63 and 64 the opposed corners of a large sheet can be conveniently and quickly nested or located in the corners formed by the two fingers of each locator so as to quickly position the sheet within the die chase apparatus. The locators are secured to the top of the plywood sheet 24 by threaded members 73 residing in slots 74. By means of this connection, the locators can be shifted within the limits of the slots to accommodate various tolerances which come about because of variations in sheet sizes or variations in the exact position for the sheet and desired by an operator of the apparatus.

It will, thus, be seen that a very efficient and economical die chase apparatus has been provided which includes in its construction efficient means for pivotally connecting the cover to the die which includes the steel rule die which performs the function of cutting sheets into various configurations in combination with the cover member. The cooperation between the cover member and the hinge members assures against lateral shifting of the cover member in closed position during the cutting function and the hinge members also guard against undue wear between the metal cover member and the sandwich of plywood sheets. The other advantages pointed out in this disclosure are also accomplished as will be well appreciated by those skilled in the art. It will be appreciated by those skilled in the art that the die may include means other than the plywood sheets for holding and supporting the steel rule die.

Although this invention has been described in its preferred form with a certain degree of particularity, it is understood that the present disclosure of the preferred form has been made only by way of example and that numerous changes in the details of construction and the combination and arrangement of parts may be resorted to without departing from the spirit and the scope of the invention as hereinafter claimed.

What is claimed is:

1. A die chase apparatus including in combination a generally rectangularly shaped metal base plate, a generally rectangularly shaped bottom plywood sheet flatly residing on said base plate and having first and second end portions, first and second die locators secured to said base plate and respectively abutting said first and second end portions of said bottom plywood sheet to locate the sheet on said plate, a generally rectangularly shaped top plywood sheet flatly residing on said bottom plywood sheet, a steel rule die having a base portion supported between said plywood sheets and having a portion extending through an opening in said top plywood sheet and terminating in a cutting edge located slightly above the top surface of said top plywood sheet, a plurality of rubber ejection members positioned on the top surface of said top plywood sheet and adjacent said cutting edge of said steel rule die to eject sheet material cut by said cutting edge, first and second hinges secured respectively to said first and second end portions of said top plywood sheet, each of said hinges comprising an angle shaped member with a first portion engaging the top of said top plywood sheet and a second portion engaging an end of said top plywood sheet with fasteners extending through said portions to secure said angle shaped member to said top plywood sheet, each of said hinges having an overhang portion which overlies the side of said top plywood sheet, a pivot member extending from each overhang portion of each hinge, each overhang portion of each hinge also having an abutment, a cover member having first and second downturned ends generally positioned at said first and second hinges, first and second elongated slots in said first and second downturned ends respectively, pivot members extending through said slots to pivotally connect said cover member to said first and second hinges, first and second side set screws in each of said first and second downturned ends of said cover member to engage said hinges and keep said cover aligned upon closing, first and second engaging portions on said cover member for engaging said abutments on said hinges in the open position of said cover, and a replaceable striker plate secured to the inside surface of said cover member.

2. A die chase assembly combination including a support member supporting at its top portion a steel rule die used for cutting sheet material, first and second hinge members secured to said support member and having a portion overhanging said support member, a pivot member extending from each overhanging portion, a cover member comprising a flat surface to engage a steel rule die for cutting sheet material and the like and having at least wo downturned edges to fit down around said support member in a closed position of said cover member, two opposed downturned edges of said cover member each having elongated slots respectively receiving said pivot member from an overhanging portion of a hinge member to permit pivoting of said cover member between an open and a closed position, said elongated slots being vertically oriented in the closed position of said cover member to permit vertical movement of said cover member relative to said support member.

3. A die chase as claimed in claim 2, wherein each overhanging portion of each hinge member has an abutment for engaging said cover member and supporting said cover member in its open position.

4. A die chase as claimed in claim 2, wherein said two opposed downturned edges of said cover member have adjustable members for engagement with said hinge members to prevent longitudinal shifting between said cover member and said support member in said closed position of said cover member.

5. A die chase as claimed in claim 2, wherein a replaceable striker plate is secured to said flat surface of said cover member.

6. A die chase as claimed in claim 2, wherein first and second spaced locators are secured to the top of said support member, each of said locators comprising a flat securing base and first and second fingers extending therefrom, each finger extending at an acute angle to the plane of the securing base, said first and second fingers each having an edge which edges are located at substantially right angles to each other.

* * * * *